US006609759B2

(12) United States Patent
Minami

(10) Patent No.: US 6,609,759 B2
(45) Date of Patent: Aug. 26, 2003

(54) CHAIR AND STAND FOR CHAIR

(75) Inventor: Nobuyuki Minami, Osaka (JP)

(73) Assignee: Oohiro Works, Ltd. (JP)

( * ) Notice: Subject to any disclaimer, the term of this patent is extended or adjusted under 35 U.S.C. 154(b) by 0 days.

(21) Appl. No.: 09/845,981

(22) Filed: Apr. 30, 2001

(65) Prior Publication Data

US 2001/0038235 A1 Nov. 8, 2001

(30) Foreign Application Priority Data

May 2, 2000 (JP) ..... 2000-133486

(51) Int. Cl.[7] ..... A47C 7/02
(52) U.S. Cl. ..... 297/452.2
(58) Field of Search ..... 297/451.2

(56) References Cited

U.S. PATENT DOCUMENTS

D192,999 S * 6/1962 Hastings et al.
4,240,662 A * 12/1980 Anderson
4,295,683 A * 10/1981 Dubbink et al.
4,841,584 A * 6/1989 Overcash et al.
6,170,096 B1 * 1/2001 Rasmussen

FOREIGN PATENT DOCUMENTS

DE DT 2646812 * 5/1977 ..... A47C/7/00
TW 373468 11/1999

* cited by examiner

*Primary Examiner*—Laurie K. Cranmer
(74) *Attorney, Agent, or Firm*—Wall Marjama & Bilinski LLP

(57) ABSTRACT

The present device provides a chair which has sufficient stability even when a person under hair washing rests her weight in a backward direction of the chair so as to have her hair washed or the like. The chair comprises plural legs, at least one of which projects long to the backward, thereby obtaining sufficient stability even when the large load is applied toward backward of the chair.

7 Claims, 5 Drawing Sheets

CHAIR AND STAND FOR CHAIR

FIELD OF THE INVENTION

The present invention relates to a chair supported by legs and, more particularly, to the structure of the legs which support the chair.

BACKGROUND OF THE INVENTION

FIG. 6 is a diagram showing the structure of a typical conventional chair. In FIG. 6, the typical conventional chair comprises a seat 4 which is composed of a seat surface 1, a back 2, and an armrest 3, a leg 5, a leg 6, and a leg 7 which support the seat 4.

The seat surface 1 is a part on which a user sits down, the back 2 is a part for supporting the user's back, and the armrest 3 is a part on which the user rests her elbows.

Further, the seat 4 composed of the seat surface 1, the back 2, and the armrest 3 is supported by the leg 5, the leg 6, and the leg 7, and the leg 5 and the leg 6 are arranged at a front positions of the seat 4 while the leg 7 is arranged at a rear position of the seat. In addition, respective legs extend vertically to a floor.

Meanwhile, when a person has her hair washed sitting on a chair at a barbershop or the like, the person under hair washing generally rests her weight on the back 2 of the chair and protrudes her head backward as shown in FIG. 7. Further, 8 denotes a hair washing machine for washing hair of a person to be hair washed.

However, in this case where a user rests her weight on the back 2 of the chair and protrudes her head backward, the load applied backward to the chair is larger than that in a case where the user sits on the chair with the back 2 stood as shown in FIG. 6.

Accordingly, there is a problem that in case of washing hair of a person to be hair washed employing the typical chair whose legs extends in a vertically downward direction from the seat surface as shown in FIG. 7, the load is applied to the chair toward backward, resulting in the lack of stability.

SUMMARY OF THE INVENTION

The present invention is made to solve the above-mentioned problem and has for its object to provide a chair which has sufficient stability even when a user is in such a posture as to cause the load applied backward to the chair to be larger.

Other objects and advantages of the present invention will become apparent from the detailed description and specific embodiments described are provided only for illustration since various additions and modifications within the spirit and scope of the invention will be apparent to those of skill in the art from the detailed description.

According to a first aspect of the present invention, there is provided a chair with plural legs, at least one of the legs projecting long to the backward. Thereby, it is possible to provide a chair having sufficient stability even when the load applied backward to the chair is larger.

According to a second aspect of the present invention, the chair of the first aspect is a chair for hair washing. Thereby, it is possible to provide a chair having sufficient stability even when a person under hair washing rests her weight in a backward direction of the chair so as to have her hair washed.

According to a third aspect of the present invention, there is provided a stand for chair having seat attachment part for attaching a seat, which comprises plural legs that support the seat attachment part, and at least one of the legs that support the seat attachment part projecting long. Thereby, sufficient stability of the chair can be obtained.

According to a fourth aspect of the present invention, there is provided the stand for chair of the third aspect wherein, at least one leg located at a rear portion of the seat projects long when the seat is attached to the set attachment part. Thereby, customization of chair by a user is possible since a seat of an arbitrary shape can be attached as well as sufficient backward stability of the chair can be obtained.

According to a fifth aspect of the present invention, the stand for chair of the third aspect is a stand for chair for hair washing. Thereby, the chair can be prevented from falling over backward even when a person under hair washing rests her weight in a backward direction of the chair so as to have her hair washed.

According to a sixth aspect of the present invention, the stand for chair of the fourth aspect is a stand for chair for hair washing. Thereby, the chair can be prevented from falling over backward even when a person under hair washing rests her weight in a backward direction of the chair so as to have her hair washed.

DETAILED DESCRIPTION OF THE PREFERRED EMBODIMENTS

Hereinafter, a chair according to a first embodiment of the present invention will be described with reference to FIGS. 1 and 2.

Embodiment 1

Figure 1:
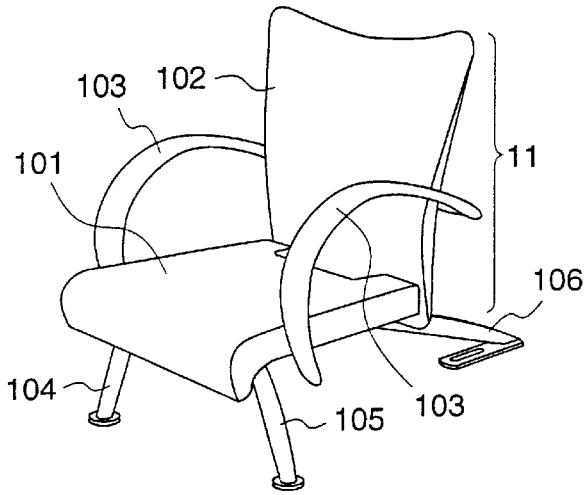
FIG. 1 is a diagram illustrating the constitution of a chair according to a first embodiment of the present invention.

FIG. 1 is a diagram illustrating the structure of a chair for hair washing according to the first embodiment of the present invention. In FIG. 1, the chair for hair washing according to the present invention comprises a seat 11 which is composed of a seat surface 101, a back 102, and an armrest 103, a leg 104, a leg 105, and a leg 106 which support the seat 11.

The seat surface 101 is a part on which a user sits down, and the back 102 is a part for supporting the user's back. The armrest 103 is a part on which the user rests her elbows.

Further, the seat 11 composed of the seat surface 101, the back 102, and the armrest 103 is supported by the leg 104, the leg 105, and the leg 106, and the leg 104 and the leg 105 are arranged at a front positions of the seat 11 while the leg 106 Is arranged at a rear position of the seat.

Figure 8:
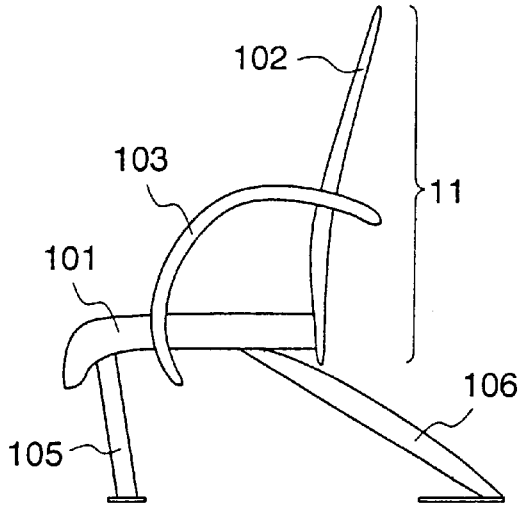
FIGS. 8 and 9 are side views of the chairs of FIGS. 1 and 3, respectively.

Further, the rear-located leg 106 among the three legs that support the seat 11 projects long to rearward of the seat 11 as shown in FIGS. 1 and 8.

Hereinafter, a specific example of how the chair for hair washing according to the first embodiment of the present invention is used will be described with reference to FIG. 2.

Figure 2:
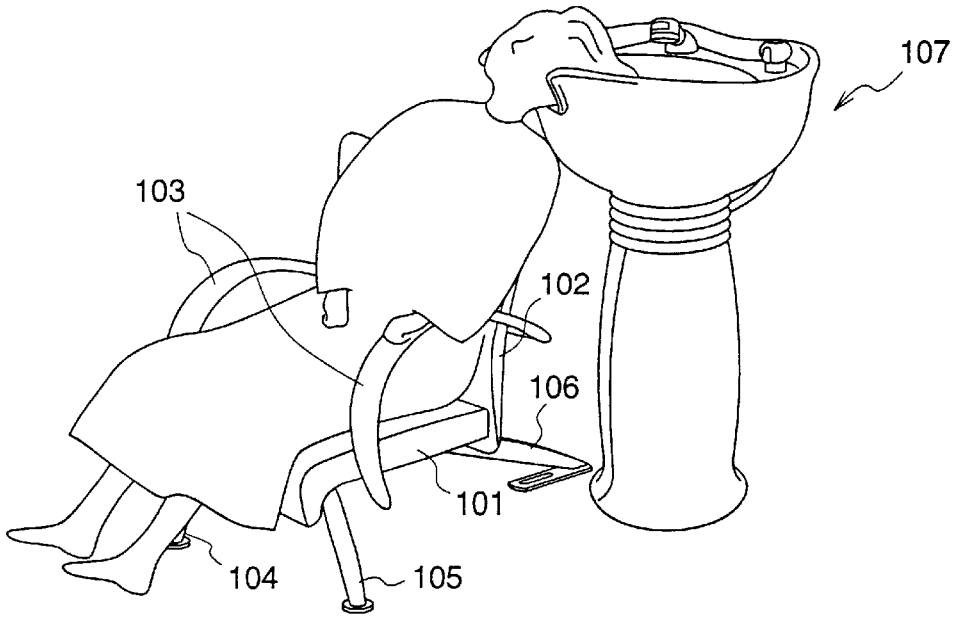
FIG. 2 is a schematic diagram for explaining an illustrative use of the chair according to the first embodiment.

FIG. 2 is a schematic diagram for explaining the specific example of how the chair for hair washing according to this first embodiment is used. Since respective constituent elements are the same as those shown in above described FIG. 1, their descriptions will be omitted. Further, 107 denotes a hair washing machine for washing hair of a person to be hair washed.

For example, in case of hair washing employing the chair for hair washing according to the first embodiment of the present invention, the person under hair washing rests her weight on the back 102 of the chair and protrudes her head backward as shown in FIG. 2.

Since the chair for hair washing according to the present invention has a structure in which the leg 106 located in a rear direction of the chair extends long in a backward direction of the chair, sufficient stability can be obtained even in a case as shown in FIG. 2 where the load applied backward to the chair is larger than that in a case where the chair is normally used.

As described above and shown in FIG. 8, by that the rear-located leg 106 among the leg 104, the leg 105, and the leg 106 which support the chair projects long to the backward, it is possible to provide a chair having sufficient backward stability even when the load applied backward to the chair is larger.

While a description was given of a chair having one among three legs which projects long to the backward in this first embodiment, it is not restricted thereto, and the same effect as in the first embodiment of the present invention can be obtained by one that has plural legs, and at least one of which projects long to the backward.

Further, while the leg 106 of the chair according to the first embodiment is preferably as long to the backward as possible, any kinds of legs are available if the grounding position of the leg 106 is at least in the rear of the position of the back 102.

While the seat 11 constructing the chair according to the first embodiment of the present invention is described as comprising the seat surface 101, the back 102, and the armrest 103, it is not restricted thereto. Any kinds of seats are available if the seat 11 allows a user to sit thereon as one comprising only the seat surface 101 and the back 102.

Embodiment 2

Hereinafter, a chair according to a second embodiment of the present invention will be described with reference to FIGS. 3, 4 and 9.

Figure 3:
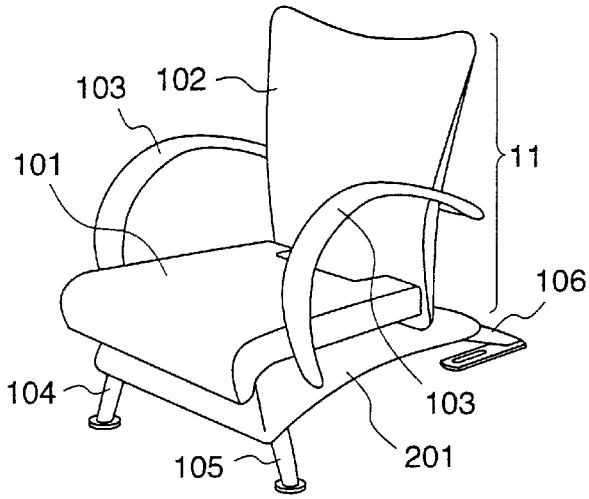
FIG. 3 is a diagram showing the constitution of a chair according to a second embodiment of the present invention.

FIG. 3 is a diagram illustrating the structure of a chair for hair washing according to the second embodiment of the present invention. In FIG. 3, the chair for hair washing according to the present invention comprises a seat 11, which is composed of a seat surface 101, a back 102, and an armrest 103, and a leg 104, a leg 105, and a leg 106 which support the seat 11.

The seat surface 101 is a part on which a user sits down, the back 102 is a part for supporting the user's back, and the armrest 103 is a part on which the user rests her elbows. Further, the leg 104, the leg 105, and the leg 106 are covered with a cover 201.

Further, the seat 11 composed of the seat surface 101 and the back 102 is supported by the leg 104, the leg 105, and the leg 106 which are covered with the cover 201, and the leg 104 and the leg 105 are arranged at a front positions of the seat 11 while the leg 106 is arranged at a rear position of the seat.

Figure 9:
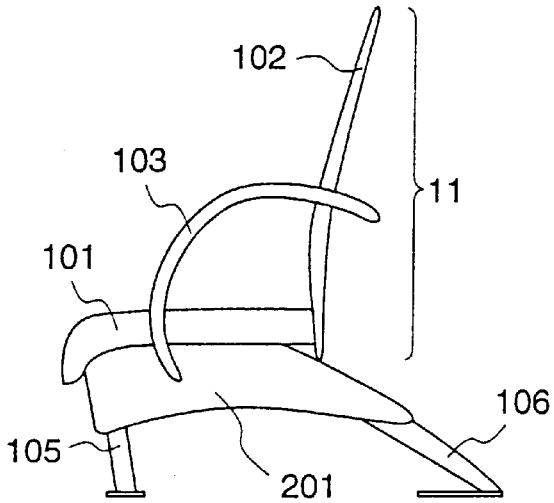

In addition as shown in FIG. 9, the rear-located leg 106 among the three legs that support the seat 11 projects long to the backward of the seat 11.

Hereinafter, a specific example of how the chair for hair washing according to the second embodiment of the present invention is used will be described with reference to FIG. 4.

Figure 4:
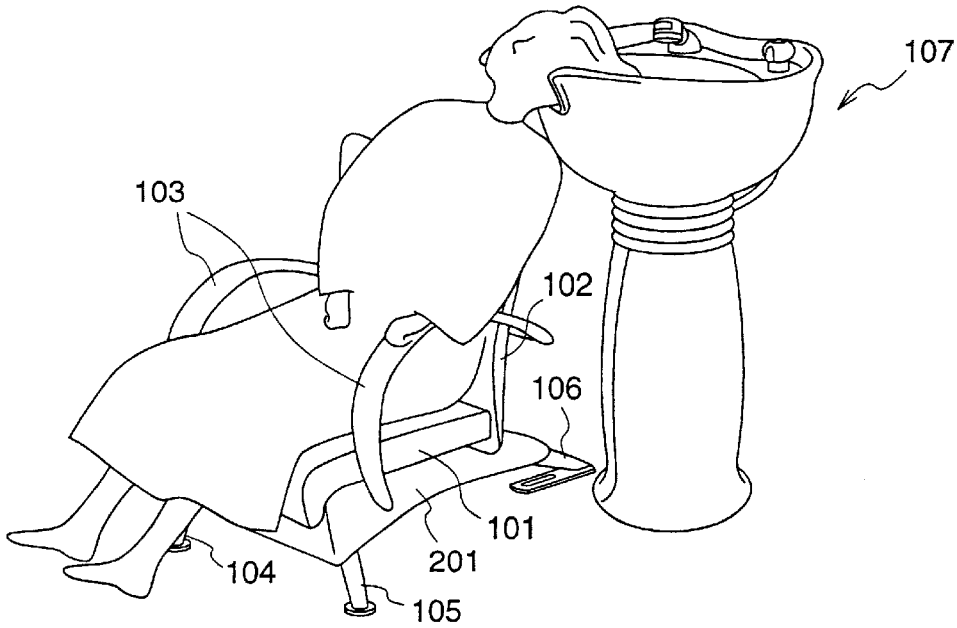
FIG. 4 is a schematic diagram for explaining an illustrative use of the chair according to the second embodiment.

FIG. 4 is a schematic diagram for explaining the specific example of how the chair for hair washing according to the second embodiment of the present invention is used. Since respective constituent elements are the same as those shown in above-described. FIG. 3, their descriptions will be omitted. Further, 107 denotes a hair washing machine for washing hair of a person to be hair washed.

For example, in case of washing the hair employing the chair for hair washing according to the second embodiment of the present invention, the person under hair washing rests her weight on the back 102 of the chair and protrudes her head backward as shown in FIG. 4.

Since the chair according to the present invention has a structure in which the leg 106 located in a rear direction of the chair extends long in a backward direction of the chair, the sufficient stability can be obtained even in a case as shown in FIG. 4 where the load applied backward to the chair is larger than that in a case where the chair is normally used.

As described above, by that the rear-located leg 106 among the leg 104, the leg 105, and the leg 106 which support the chair projects long to the backward, it is possible to provide a chair which has the sufficient backward stability even when the load applied backward to the chair is larger.

While a chair having one among three legs which projects long to the backward is described in the second embodiment, it is not restricted thereto, and the same effect as in the second embodiment of the present invention can be obtained by one that has plural legs among which at least one projects long to the backward.

Further, while the leg 106 of the chair according to the second embodiment is preferably as long to the backward as possible, any kinds of legs are available if the grounding position of the leg 106 is at least in the rear of the position of the back 102.

While the seat 11 constructing the chair according to the second embodiment of the present invention is described as comprising the seat surface 101, the back 102, and the armrest 103, it is not restricted thereto. Any kinds of seats are available if the seat 11 allows a user to sit thereon as one comprising only the seat surface 101 and the back 102.

Embodiment 3

Hereinafter, a stand for chair according to the third embodiment of the present invention will be described with reference to FIG. 5.

Figure 5:
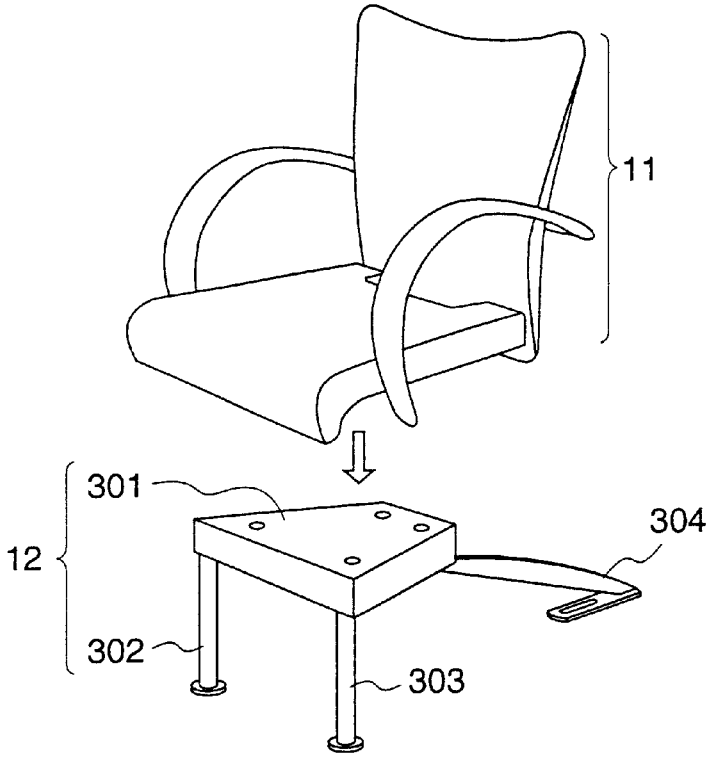
FIG. 5 is a diagram illustrating the constitution of a stand for chair according to a third embodiment of the present invention.
Figure 6:
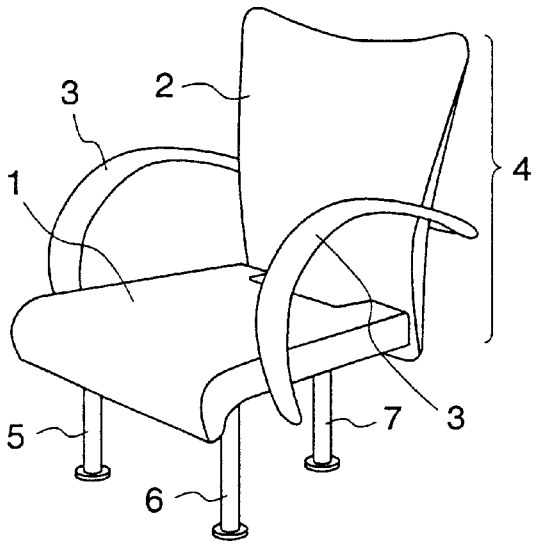
FIG. 6 is a diagram showing the constitution of a conventional typical chair.
Figure 7:
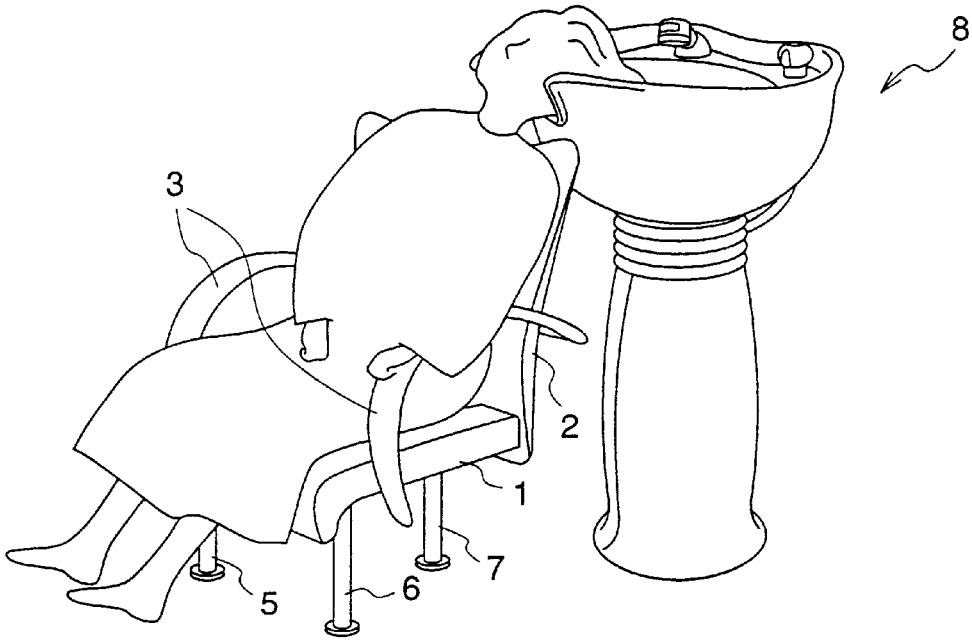
FIG. 7 is a schematic diagram for explaining an illustrative use of the conventional typical chair.

FIG. 5 is a diagram for illustrating the structure of a stand for chair according to the third embodiment of the present invention.

As described in FIG. 5, the stand for chair 12 according to the third embodiment of the present invention comprises a seat attachment part 301, a leg 302, a leg 303, and a leg 304.

The seat attachment part 301 is a part to which the seat 11 is attached, and which is supported by the leg 302, the leg 303, and the leg 304. The seat 11 is the same one as that described in the above-mentioned first embodiment, and its description will be omitted.

Further, among three legs supporting the seat attachment part 301, the leg 304 projects longer than the leg 302 and the leg 303 as shown in FIG. 5.

When the chair is constructed employing this stand for chair 12, the seat 11 is attached to the seat attachment part 301 so as to locate the back of the seat 1 in a direction supported by the leg 304, thereby obtaining the structure similar to that of the chair described in FIG. 1.

Therefore, even in a case where the load toward backward is larger, that is, the chair is used in a state where a person under hair washing rests her weight on the back of the chair and protrudes her head backward at the hair washing or the like, the chair can be prevented from falling over backward since the chair is constructed such that the leg 304 supporting the chair projects long to rearward of the chair.

Further, because the stand for a seat is provided with the seat attachment part, it is possible to attach a seat of an arbitrary shape to the seat attachment part, thereby enabling customization of a chair.

Further, while in the third embodiment a description was given of the stand for chair 12 that has three legs, one of which projecting long backward, it is not restricted thereto. Any kinds of stands for chair 12 that have plural legs at least one of which projects long in at least one direction can be constructed with the same effects obtained.

In addition, while the leg 304 of the stand for chair 12 according to the third embodiment is preferable to be as long toward backward as possible, the leg 304 whose grounding position is at least in the rear of the position of the back when the seat 11 is attached is available.

What is claimed is:

1. A chair for a person seated therein to have his or her hair washed in a washstand situated behind said chair that includes:

a horizontally disposed seat and a vertically disposed back rest having a vertical height above said seat such that a person seated in said chair can lean back and have said persons hair washed in a washstand situated behind said back rest, at least two spaced apart front legs attached to the seat and at least one inclined rear leg attached to the seat, said at least one inclined rear leg being aligned along the center of said seat and extending rearwardly and downwardly from said seat a sufficient distance beyond a vertical plane containing the back rest such that the chair remains stable when a person seated in the chair leans back to have his or her hair washed, said chair being stably grounded relative to a floor surface.

2. The chair of claim 1, wherein said front legs are symmetrically spaced about the center of said chair.

3. The chair of claim 1, wherein said front legs are vertically disposed from said seat.

4. The chair of claim 1, wherein the at least one rear leg has a length that is greater than the front legs.

5. A support for a hair washing chair that includes:

a stand having at least two front legs spaced apart at the front of the stand and a rear leg centrally located at the back of the chair;

a seat attached to said stand;

a backrest attached to the back of said stand having a height such that a person seated upon said seat can lean back far enough so that the person can have his or her hair washed in a basin located behind said backrest;

said rear leg extending rearwardly and downwardly from said stand a sufficient distance beyond a vertical plane containing the backrest of said stand such that the stand will remain stable when a person seated on said seat leans back to have his or her hair washed, said chair being stably grounded to a floor surface.

6. The support of claim 5, wherein said front legs are vertically disposed and symmetrically spaced about the center of said stand.

7. The support of claim 5, wherein the rear leg has a length that is greater than that of the front legs.

* * * * *